US005669824A

United States Patent [19]

Aizawa et al.

[11] Patent Number: 5,669,824

[45] Date of Patent: Sep. 23, 1997

[54] IRON CLUB AND IRON CLUB SET

[75] Inventors: Yuichi Aizawa; Yutaka Oku, both of Tokyo, Japan

[73] Assignee: Daiwa Seiko, Inc., Tokyo, Japan

[21] Appl. No.: 613,619

[22] Filed: Mar. 11, 1996

[30] Foreign Application Priority Data

Mar. 9, 1995 [JP] Japan ..... 7-049777

[51] Int. Cl.[6] ..... A63B 53/04

[52] U.S. Cl. ..... 473/291; 473/349; 473/350

[58] Field of Search ..... 473/287, 288, 473/289, 290, 291, 292, 324, 341, 349, 350

[56] References Cited

U.S. PATENT DOCUMENTS

| | | | |
|---|---|---|---|
| Re. 34,925 | 5/1995 | McKeighen | 473/305 |
| 1,139,985 | 5/1915 | Legh | 473/350 |
| 3,751,035 | 8/1973 | Lockwood | 473/290 |
| 4,715,601 | 12/1987 | Lamanna | 473/291 |
| 4,754,969 | 7/1988 | Kobayashi | 473/290 |
| 4,919,430 | 4/1990 | Antonious | 473/350 |
| 4,932,658 | 6/1990 | Antonious | 473/350 |
| 5,333,872 | 8/1994 | Manning | 473/291 |

FOREIGN PATENT DOCUMENTS

| | | |
|---|---|---|
| 50-10370 | 5/1973 | Japan . |
| 2-32306 | 3/1990 | Japan . |

*Primary Examiner*—Sebastiano Passaniti
*Attorney, Agent, or Firm*—Longacre & White

[57] ABSTRACT

An iron club and a set of the iron clubs which are improved to ensure a stable directional controllability and a flight of the hitted ball to the target, and to increase the flight distance of the hitted ball. The iron club is characterized in that a recessed portion is defined on a back portion of a head of the club, except for a peripheral portion thereof, so that the thickness of a face portion gradually decreases from the top, sole, toe, and the heal sides toward a sweet spot, and a thin portion which has the minimum thickness being provided on the sweet spot.

13 Claims, 5 Drawing Sheets

IRON CLUB AND IRON CLUB SET

BACKGROUND OF THE INVENTION

The invention relates to an iron club and an iron clubs set thereof.

In general, a head of an iron club includes a hosel portion and a face portion which are integrally made of a metal such as soft iron or stainless steel into a shape adapted to the number of the club. It is well known that a structure having a recessed portion on a back portion of the head increases moment of inertia of the head as hitting a ball.

FIG. 11 illustrates an iron club 1 disclosed in Japanese Unexamined Utility Model Publication (Kokai) No. 50-10370, which comprises a head 3 including a recessed portion 7 on a back portion 5. The recessed portion 7 defines a section in the form of an arc or an arch so that the thickness of the head 3 decreases gradually from the top and sole toward the center of the face portion 9.

By using the iron club 1, a player can easily hit and carry a ball 11 to a target point since the increased moment of inertia about an axis extending from the toe to the heal minimize the rotation of the head 3 about the axis as shown by an arrow in FIG. 11.

Although the iron club 1 described above is provided with measures for preventing the rotation about the axis extending from the toe to the heal, no measures are provided to prevent a rotation about an axis extending from the top to the sole.

The rotation of the head 3 about the shaft 13 tends to make a hook or slice ball which limits the directional controllability of the hit ball.

Additionally, in Japanese Examined Utility Model Publication (Kokoku) No. 2-32306, a golf club 21 with a head 17 which defines a hollow portion 15 is disclosed although the publication describes a device of a wood club. The head 17 defines a face portion 19 which is formed into an arch configuration with a minimum thickness at the center thereof so that the thickness increases gradually from the central portion to the toe and the heal.

According to the golf club 21, the moment of inertia about an axis extending from the top to the sole is increased to minimize the rotation of the head 17 about the shaft of the club as hitting a ball, thus, the directional controllability of the hit ball is improved. However, the head tends to rotate about an axis extending from the toe to heal, since no measures for preventing the rotation of the head about the axis extending from the toe to heal is provided, which makes the hitted ball miss the target.

SUMMARY OF THE INVENTION

The invention is directed to solve the problem described above, and to provide an iron club and a set of the iron clubs which are improved to ensure a stable directional controllability and a flight of the hit ball to the target, and to increase the flight distance of the hit ball.

In order to solve the problems described above, an iron club of the present invention is characterized in that a recessed portion is defined on a back portion of a head of the club, except for a peripheral portion thereof, so that the thickness of a face portion gradually decreases from the top, sole, toe, and the heal sides toward a sweet spot, and a thin portion which has the minimum thickness being provided on the sweet spot.

An iron club set of the present invention characterized by comprising long iron clubs, middle iron clubs and short iron clubs, in which a recessed portion is defined on a back portion of a head of each iron club, except for a peripheral portion thereof, so that the thickness of a face portion gradually decreases from the top, sole, toe, and the heal sides toward a sweet spot, a thin portion which has the minimum thickness being provided on the sweet spot, and shorter the iron club from the long iron through the middle iron to the short iron, smaller the thickness of the thin portion being provided. In a preferred embodiment of the iron club set, a shorter the iron club from the long iron through the middle iron to the short iron, larger the area of the thin portion is provided. In a preferred embodiment of the iron club set, shorter the iron club from the long iron through the middle iron to the short iron, smaller the amount of the variation of the thickness of the recessed portion toward the thin portion.

According to the iron club of the invention, the mass of the head is distributed along the peripheral portion, and the moment of inertia of the top, sole, toe and heal sides of the head are increased to prevent the movement of the head.

According to the iron club set of the invention, when a ball hit by the club at the sweet spot, shorter the iron club from a long iron through a middle iron to a short iron, longer the engagement with the hit ball, that is, the contact time with the hitted ball is resulted, which allows an easy ball control, and longer the iron club, higher the rigidity of the peripheral around the sweet spot SS is provided, which results in a long flight distance.

DETAILED DESCRIPTION OF THE PREFERRED EMBODIMENTS

Figure 1:
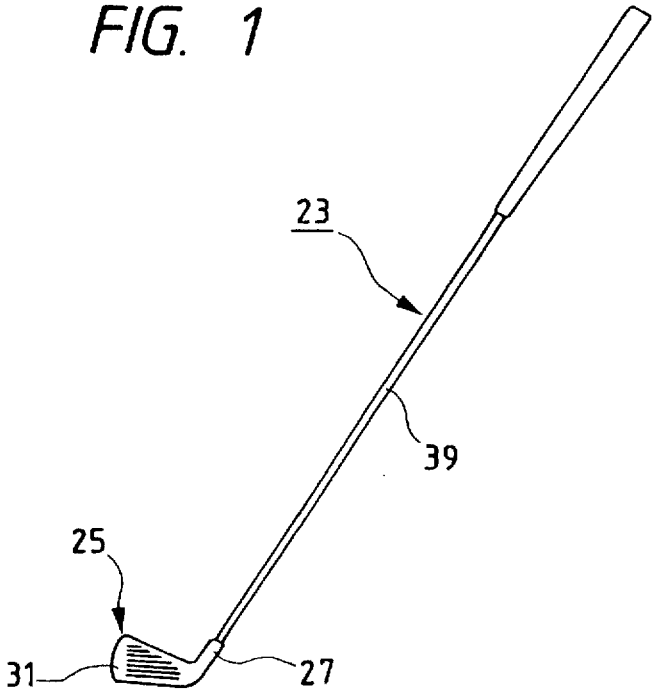
FIG. 1 is a general perspective view of the iron club according to the invention.

The embodiments of the invention will be described hereinafter with reference with the attached drawings.

FIGS. 1 to 4 illustrate an embodiment of an iron club according to the present invention, in which 23 denotes a second iron club which comprises a head 25 made of a metal such as soft iron or stainless steel. The head 25 includes a hosel portion 27, sole portion 29 and face portion 31 which are integrally formed as in the conventional head.

A recessed portion 35 is provided on a back portion 33 of the head 25, except for a peripheral portion, by four angled surfaces 35*a*–35*d* which extend from the top, the sole, the toe, and the heal to the sweet spot SS of the face portion 31 so that their thicknesses m gradually decrease. A thin portion 37 are defined on the face portion 31 at the sweet spot SS. The thin portion 37 defines a planer surface located as a bottom of the recessed portion 35.

Thus, the mass of the head 25 is distributed along the peripheral portion since the recessed portion 35 is provided on the back portion 33 of the head 25 except for the peripheral portion.

Hence, the moment of inertia of the top, sole, toe and heal sides of the head 25 are increased to prevent the head 25 from movement in the vertical direction and the rotation about the shaft 39, which eliminates the hook or slice ball.

Therefore, according to the embodiment, a player can easily hit to carry a ball straightly to a desired flight distance compared with the conventional head since the directional controllability is stabilized.

Further, in the head 25, the rigidity of the face portion 31, which increases radially from the sweet spot SS to the peripheral portion, makes the initial speed of the hit ball larger than that in the conventional head, when the ball is hit by the sweet spot SS, which results in the increased the flight distance. Even if the ball is hit by the club at the face portion other than the sweet spot SS, the deterioration in the flight distance is small because of the high rigidity of the peripheral portion about the thin portion 37.

A relatively small thickness and a relatively large area of the thin portion 37 provides an iron club suitable for a middle or short iron since the contact time with a ball at hitting is increased to allow an easy ball control while the flight distance of the hit ball decreases.

Figure 5:
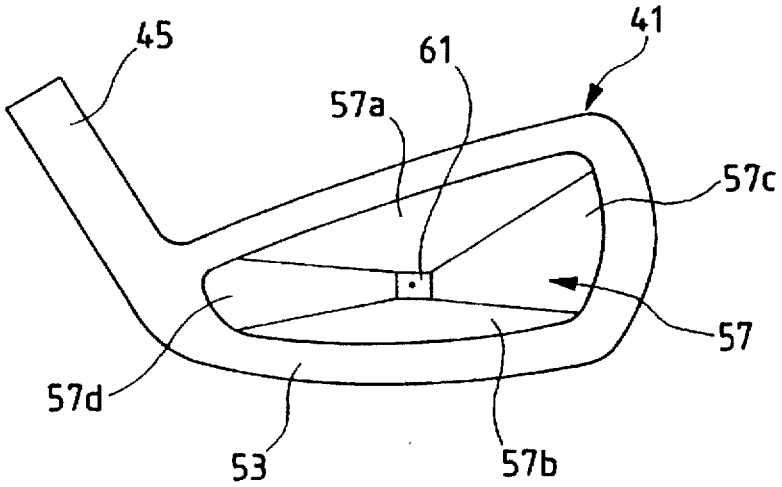
FIG. 5 is a back view of a head of a fifth iron of an iron club set according to the invention.
Figure 6:
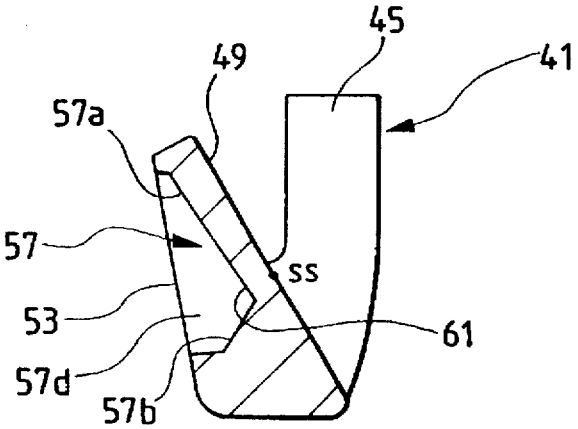
FIG. 6 is a side section of a head of FIG. 5.
Figure 7:
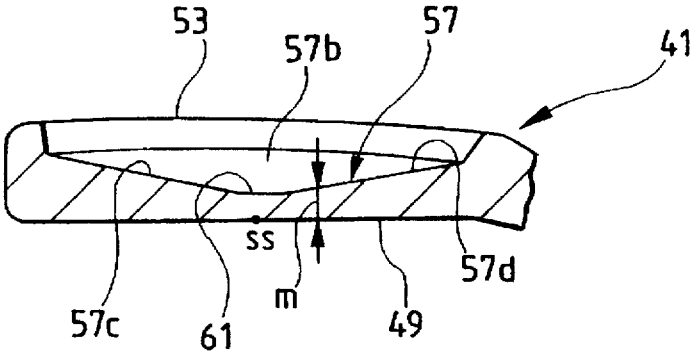
FIG. 7 is a longitudinal section of a head of FIG. 5.
Figure 8:
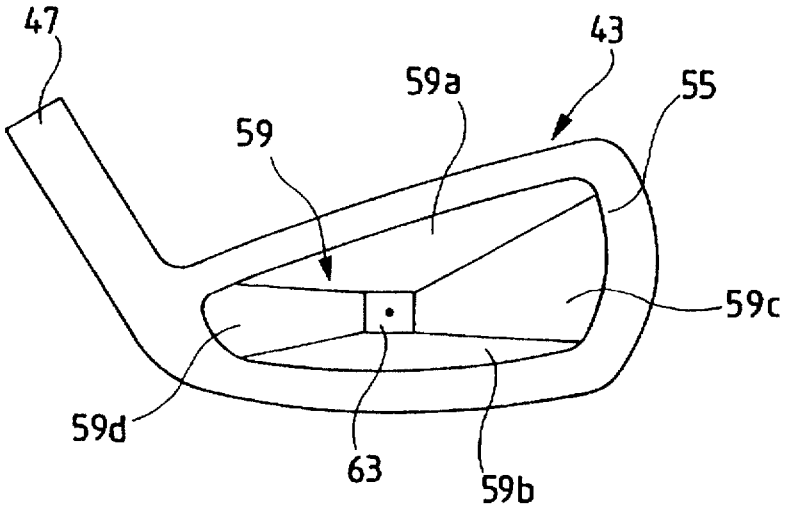
FIG. 8 is a back view of a head of an eighth iron of an iron club set according to the invention.
Figure 9:
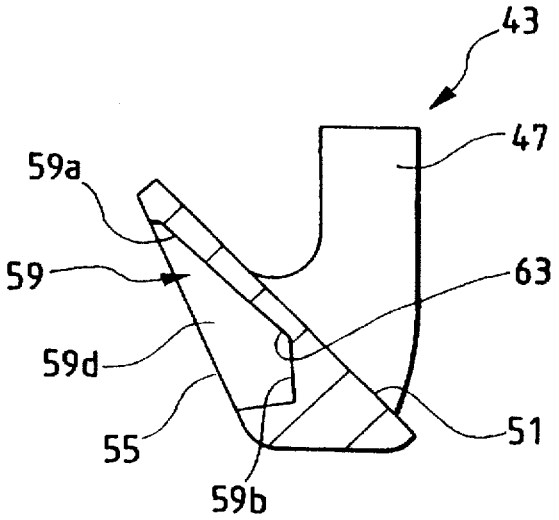
FIG. 9 is a side section of a head of FIG. 8.
Figure 10:
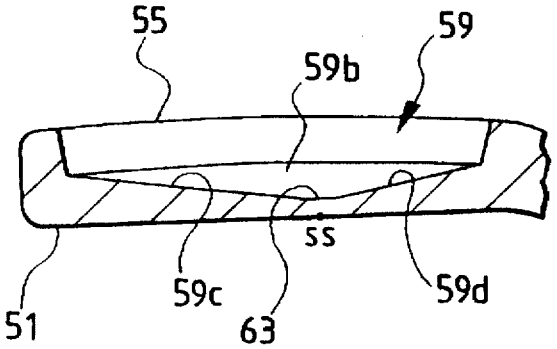
FIG. 10 is a longitudinal section of a head of FIG. 8.
Figure 11:
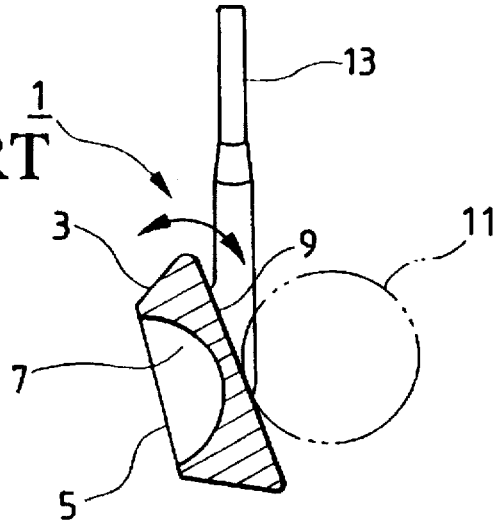
FIG. 11 PRIOR ART
FIG. 11 is a sectional view of a conventional head.
Figure 12:
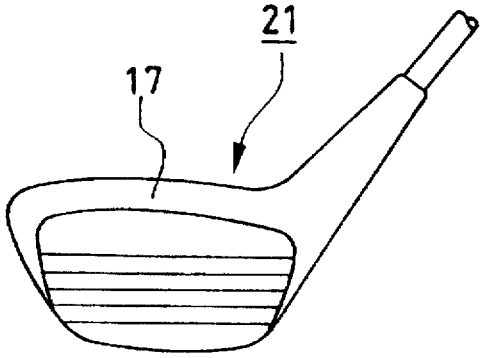
FIG. 12 PRIOR ART
FIG. 12 is a front view of a conventional golf club.
Figure 13:
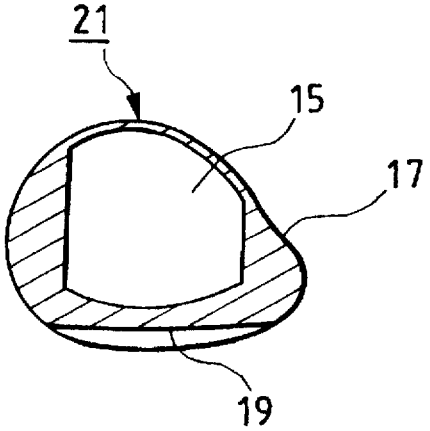
FIG. 13 PRIOR ART
FIG. 13 is a side section of the golf club shown in FIG. 12.

FIGS. 5 to 10 illustrate embodiments of iron clubs of the present invention, in particular, FIGS. 5 to 7 illustrate a head of a fifth iron, and FIGS. 8 to 10 illustrate a head of an eighth iron. These iron clubs as well as the second iron club shown in FIGS. 1 to 4 cooperatively constitute an iron club set of the present invention.

Heads 41 and 43 of these iron clubs include hosel portions 45 and 47, and face portions 49 and 51 which are integrally formed. Larger the number of the club, larger the loft angle is provided, and closer the sweet spot SS to the heal from the toe is positioned.

Recessed portions 57 and 59 are provided on back portions 53 and 55 of the heads 41 and 43, except for a peripheral portions, by four angled surfaces 57*a*–57*d* and 59*a*–59*d* which extend from the top, the sole, the toe, and the heal to the respective sweet spots SS of the face portions 49 and 51 so that their thicknesses m gradually decrease and shown in FIGS. 5 and 8. Thin portions 61 and 63 each in the form of rectangle are formed at locations opposite from the respective sweet spots SS of the face portions 49 and 51 to define the minimal thicknesses of the face portions 49 and 51.

Figure 2:
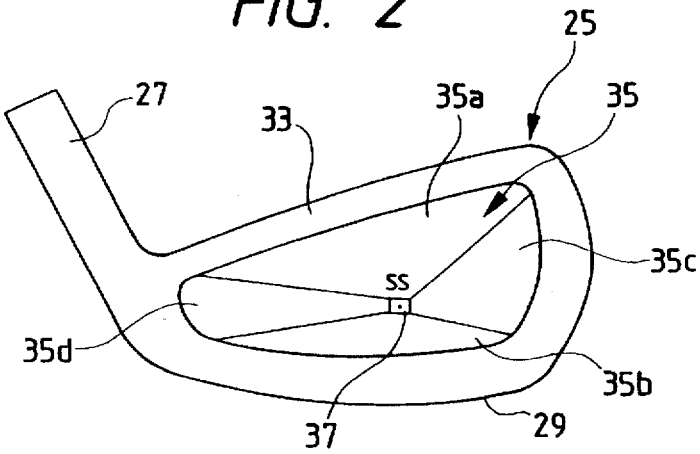
FIG. 2 is a back view of a head of a second iron.
Figure 3:
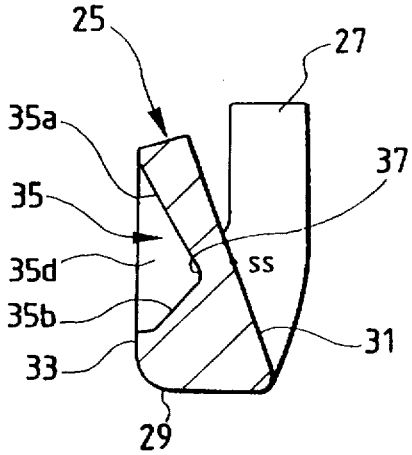
FIG. 3 is a side section of a head of FIG. 2.
Figure 4:
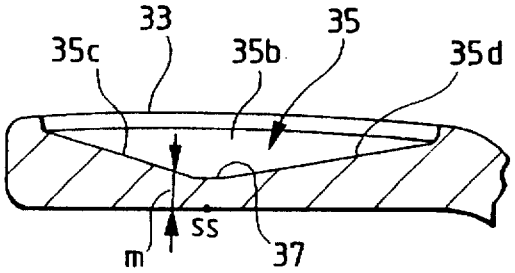
FIG. 4 is a longitudinal section of a head of FIG. 2.

In the iron club set, larger the number of the respective iron clubs from a middle iron to a short iron, smaller the thickness of the thin portions 61 and 63, and larger the area of the thin portions 61 and 63 are provided, compared with the thin portion 37 shown in FIG. 2.

Further, in the iron club set, larger the number of the iron club from a middle iron to a short iron, smaller the over all thickness of the head 25, 41 and 43 is provided, and smaller the amount of the variation of the thickness of the recessed portions 35, 57 and 59 toward the thin portions 37, 61 and 63 is provided.

Thus, in the iron club set of the invention, the mass of each heads 25, 41 and 43 is also distributed along the respective peripheral portions since the respective recessed portions 35, 57 and 59 are provided on the back portions 33, 53 and 55 of the heads 25, 41 and 43, except for the peripheral portions, whereby the moment of inertia of the top, sole, toe and heal sides is increased to prevent the heads 25, 41 and 43 from the movement in the vertical direction and the rotation about the shaft 39, which eliminates the hook or slice ball.

Further, when a ball hit by the club at the sweet spot, shorter the iron club, longer the engagement with the hitted ball, that is, the contact time with the hitted ball is resulted, and longer the iron club, higher the rigidity of the peripheral around the sweet spot SS is provided since, from a long iron through a middle iron to a short iron, smaller the amount of the variation of the thickness of the recessed portions 35, 57 and 59 toward the thin portions 37, 61 and 63, and larger the area of the thin portions 37, 61 and 63 are provided.

Therefore, according to the present invention, the direction of hit ball can be easily controlled, and longer the iron club, higher the initial speed of the hit ball is provided compared with the conventional head, which results in an increased the flight distance.

Figure 14:
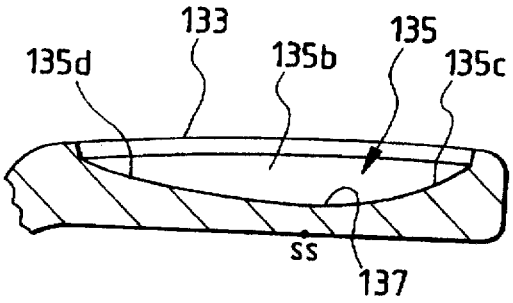
FIG. 14 is a longitudinal section of a head of a second iron according to the invention.
Figure 15:
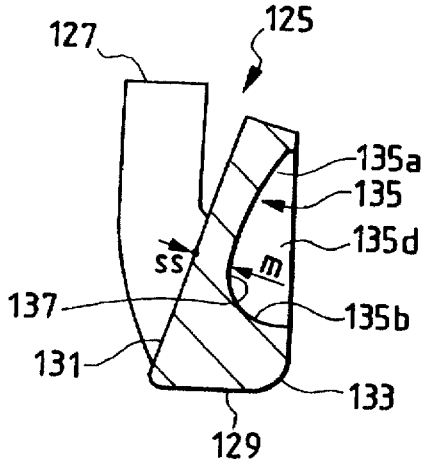
FIG. 15 is a side section of the head shown in FIG. 14.
Figure 16:
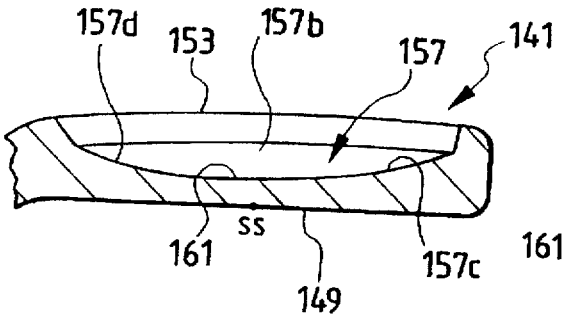
FIG. 16 is a longitudinal section of a head of a fifth iron according to the invention.
Figure 17:
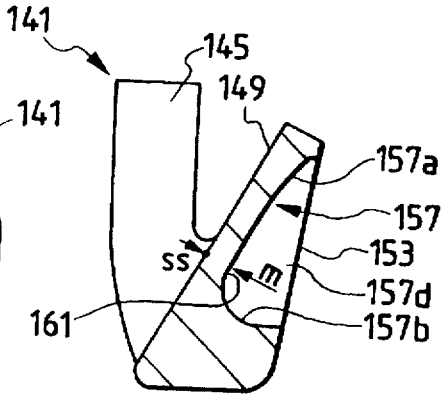
FIG. 17 is a side section of the head shown in FIG. 16.
Figure 18:
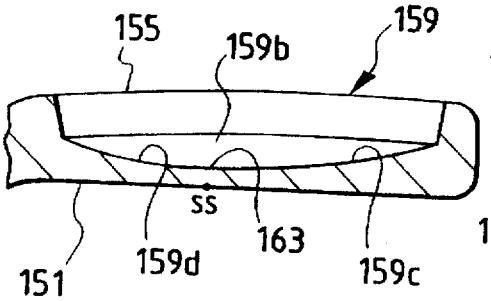
FIG. 18 is a longitudinal section of a head of an eighth iron according to the present invention.
Figure 19:
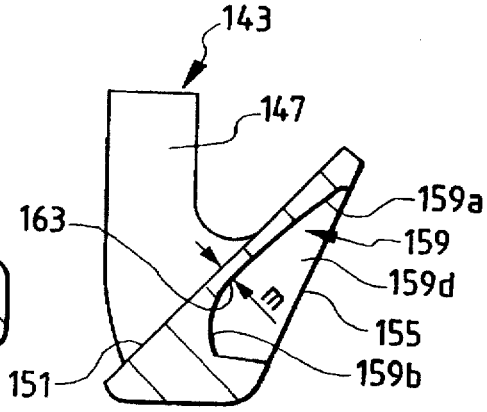
FIG. 19 is a side section of the head shown in FIG. 18.

FIGS. 14 to 19 illustrate embodiments of iron clubs of the present invention, in particular, FIGS. 14 and 15 illustrate a head of a second iron, FIGS. 16 to 17 illustrate a head of a fifth iron, and FIGS. 18 to 19 illustrate a head of an eighth iron. These iron clubs cooperatively constitute an iron club set of the present invention.

Heads 125, 141 and 143 of these iron clubs include hosel portions 127, 145 and 147, and face portions 131, 149 and 151 which are integrally formed. Larger the number of the club, larger the loft angle is provided, and closer the sweet spot SS to the heal from the toe is positioned.

Recessed portions 135, 157 and 159 are provided on back portions 133, 153 and 155 of the heads 125, 141 and 143, except for a peripheral portions, by curved surfaces 135*a*–135*d*, 157*a*–157*d* and 159*a*–159*d* which extend from the top, the sole, the toe, and the heal to the respective sweet spots SS of the face portions 131, 149 and 151 and smoothly merge together so that their thicknesses m gradually decrease as shown in FIGS. 15, 17 and 19. That is to say, the recessed portions 135, 157 and 159 are formed by smooth concave surface made up of four curved surfaces 135*a*–135*d*, 157*a*–157*d* and 159*a*–159*d*. Thin portions 137, 161 and 163 are located opposite from the respective sweet spots SS of the face portions 131, 149 and 151 and on the smooth concave surfaces of the recessed portions 135, 157 and 159 to define the minimal thicknesses of the face portions 137, 149 and 151.

In the iron club set, larger the number of the respective iron clubs from a long iron through a middle iron to a short iron, smaller the thickness of the thin portions 137, 161 and 163.

Further, in the iron club set, larger the number of the iron club from a long iron through a middle iron to a short iron, smaller the over all thickness of the head 125, 141 and 143 is provided, and smaller the amount of the variation of the thickness of the recessed portions 135, 157 and 159 toward the thin portions 137, 161 and. 163 is provided.

Thus, in the iron club set of the invention, the mass of each heads 125, 141 and 143 is also distributed along the respective peripheral portions since the respective recessed portions 135, 157 and 159 are provided on the back portions 133, 153 and 155 of the heads 125, 141 and 143, except for the peripheral portions, whereby the moment of inertia of the top, sole, toe and heal sides is increased to prevent the heads 125, 141 and 143 from the movement in the vertical direction and the rotation about the shaft, which eliminates the hook or slice ball.

Further, when a ball hit by the club at the sweet spot, shorter the iron club, longer the engagement with the hitted ball, that is, the contact time with the hitted ball is resulted, and longer the iron club, higher the rigidity of the peripheral around the sweet spot SS is provided since, from a long iron through a middle iron to a short iron, smaller the amount of the variation of the thickness of the recessed portions 135, 157 and 159 toward the thin portions 137, 161 and 63.

Therefore, according to the present invention, the direction of hit ball can be easily controlled, and longer the iron club, higher the initial speed of the hit ball is provided compared with the conventional head, which results in an increased the flight distance.

As described above, according to the iron clubs of the present invention, a player can easily hit to carry a ball straightly to a desired flight distance compared with the conventional head since the head does not move in the vertical direction nor rotate about the shaft.

According to the iron club sets of the present invention, the initial speed of the hit ball is larger then that of the conventional one, when the ball is hit by the sweet spot, which results in the increased the flight distance since the rigidity of the face portion increases radially from the sweet spot to the peripheral portion, and in case of a long iron club, even if a ball is hit by the club at the face portion other than the sweet spot, the deterioration in the flight distance is small because of the high rigidity of the peripheral portion around the thin portion.

Further, an advantage is obtained that, the higher the number of the club from a middle to short iron club, the longer the contact time between the thin portion and the hit ball is resulted, which provide an easy ball control.

By changing the amount of the variation of the thickness of the recessed portion, and by providing a larger area of the thin portion, the contact time between the face portion and the hitted ball becomes further longer to provide an easier ball control.

What is claimed is:

1. An iron club comprising a head having a face portion, a back portion, and top, sole, toe, and heel sides, wherein:

the back portion, except for a peripheral portion thereof, is recessed to define a recessed portion, said recessed portion having four surfaces each respectively extending from the peripheral portion along one of said top, sole, toe and heel sides, to a thin portion, said four surfaces being contoured such that a thickness of the face portion gradually decreases from each of the top, sole, toe, and heel sides to said thin portion corresponding to a sweet spot; and the thin portion defines a minimum thickness of the face portion.

2. An iron club according to claim 1, wherein the recessed portion has four surfaces each extending from respective one of the top, sole, toe and heal sides to the thin portion.

3. An iron club according to claim 1, wherein each of the four surfaces is planar.

4. An iron club according to claim 3, wherein the thin portion has a rectangular surface.

5. An iron club head according to claim 3, wherein adjacent ones of the four surfaces share a linear boundary.

6. An iron club head according to claim 3, wherein each of the four surfaces is substantially triangular.

7. An iron club according to claim 1, wherein each of the four surfaces is curved.

8. An iron club according to claim 7, wherein the four surfaces smoothly merge together to form a smooth concave surface.

9. An iron club set comprising a long iron club, a middle iron club and a short iron club, each of the clubs including a head having a face portion, a back portion, and top, sole, toe, and heel sides, wherein:

the back portion, except for a peripheral portion thereof, is recessed extending to a thin surface to define a recessed portion which decreases the thickness of the face portion gradually from the top, sole, toe, and heel sides to a thin portion corresponding to a sweet spot;

the thin portion defines a minimum thickness of the face portion in each club along an area corresponding to said thin surface; and the shorter the iron club from the long iron club through the middle iron club to the short iron club, the smaller the thickness of the thin portion being provided.

10. An iron club set according to claim 9, wherein the shorter the iron club from the long iron club through the middle iron club to the short iron club, the larger the area of the thin surface is provided.

11. An iron club set according to claim 9, wherein the shorter the iron club from the long iron club through the middle iron club to the short iron club, the smaller the amount of the variation of the thickness of the face portion toward the thin portion by the recessed portion.

12. An iron club set according to claim 9, wherein the shorter the iron club from the long iron club through the middle iron club to the short iron club, the nearer to the heel side the thin portion is located.

13. An iron club set comprising a long iron club, a middle iron club and a short iron club, each of the clubs including a head having a face portion, a back portion, and top, sole, toe, and heel sides, wherein:

the back portion, except for a peripheral portion thereof, is recessed to define a recessed portion which decreases the thickness of the face portion gradually from the top, sole, toe, and heel sides to a thin portion corresponding to a sweet spot;

the thin portion defines a minimum thickness of the face portion in each club and has a planar surface; and as the number of the iron increases from the long iron club through the middle iron club to the short iron club, the larger the planar surface of the thin portion is.

* * * * *